US010424848B2

(12) United States Patent
Deng

(10) Patent No.: US 10,424,848 B2
(45) Date of Patent: Sep. 24, 2019

(54) EASILY ASSEMBLED AND MAINTAINED HEADPHONE WIRE

(71) Applicant: C CABLE CO., LTD., New Taipei (TW)

(72) Inventor: Meiying Deng, New Taipei (TW)

(73) Assignee: C CABLE CO., LTD., New Taipei (TW)

( * ) Notice: Subject to any disclaimer, the term of this patent is extended or adjusted under 35 U.S.C. 154(b) by 0 days.

(21) Appl. No.: 15/984,415

(22) Filed: May 21, 2018

(65) Prior Publication Data

US 2018/0375224 A1 Dec. 27, 2018

(30) Foreign Application Priority Data

Jun. 26, 2017 (CN) ..... 2017 2 0753930 U

(51) Int. Cl.

| | |
|---|---|
| ***H01R 4/06*** | (2006.01) |
| ***H01B 7/04*** | (2006.01) |
| ***H01B 7/40*** | (2006.01) |
| ***H01R 11/11*** | (2006.01) |
| ***H01B 7/00*** | (2006.01) |
| ***H04R 1/10*** | (2006.01) |

(52) U.S. Cl.

CPC ..... *H01R 4/06* (2013.01); *H01B 7/0009* (2013.01); *H01B 7/04* (2013.01); *H01B 7/40* (2013.01); *H04R 1/1033* (2013.01); *H01R 11/11* (2013.01)

(58) Field of Classification Search

CPC ..... H01R 4/06; H01R 1/10; H01R 1/1033; H01B 7/04; H01B 7/40; H01B 7/00

USPC ..... 174/74 R

See application file for complete search history.

(56) References Cited

U.S. PATENT DOCUMENTS

| | | | | | |
|---|---|---|---|---|---|
| 2,330,608 | A * | 9/1943 | Nachtman | C23F 4/00 | 205/206 |
| 2,385,792 | A * | 10/1945 | Carlson | H01R 4/20 | 403/284 |
| 3,566,008 | A * | 2/1971 | Ettlinger | H01R 4/62 | 174/84 R |
| 3,831,132 | A * | 8/1974 | Bowden, Jr. | H01R 4/185 | 439/442 |
| 3,869,428 | A * | 3/1975 | Mosimann | C08G 18/3206 | 528/275 |
| 4,317,277 | A * | 3/1982 | Bennett | B23K 11/163 | 174/94 R |
| 5,492,721 | A * | 2/1996 | Berthold | H01B 13/065 | 427/178 |

(Continued)

*Primary Examiner* — Andargie M Aychillhum
*Assistant Examiner* — Michael F McAllister
(74) *Attorney, Agent, or Firm* — Leong C. Lei

(57) ABSTRACT

A headphone wire includes a plurality of inner cores each having a conductor and enamel coating layer covered on the conductor so as to provide an insulation effect. The inner cores are covered with an insulating skin and interwoven together inside it; one end of the inner cores is penetrated out of the insulating skin to form an electroplating end, on which a tin plated portion is electroplated; and a connecting terminal is riveted onto the tin plated portion. Whereby, space can be saved and the flexibility is better because the inner cores are interwoven together, and the riveting is used instead of spot welding connecting, capable of increasing service life and being easy to be assembled and maintained.

8 Claims, 2 Drawing Sheets

(56) References Cited

U.S. PATENT DOCUMENTS

| | | | | |
|---|---|---|---|---|
| 5,593,406 | A * | 1/1997 | Eggers | A61B 18/082 606/28 |
| 8,440,066 | B2 * | 5/2013 | Yanada | C25D 3/30 106/1.25 |
| 2015/0229090 | A1 * | 8/2015 | Hasagawa | H01R 43/0484 174/74 R |
| 2016/0155538 | A1 * | 6/2016 | Karlen | H01B 7/306 174/74 R |

* cited by examiner

EASILY ASSEMBLED AND MAINTAINED HEADPHONE WIRE

(a) TECHNICAL FIELD OF THE INVENTION

The present invention relates to a headphone wire design and material, and more particularly to a headphone wire easily assembled, easily maintained, facilitating space saving, and increasing service life.

(b) DESCRIPTION OF THE PRIOR ART

The external parts of general headphone wires are formed by covering metal conductors of various different materials such as copper wires, aluminum wires or silver alloy wires with flexible colloid. But, the current headphone wires are larger in entire diameter and insufficient in flexibility, and conventional connecting terminals are mostly connected therewith by means of spot welding. Therefore, if used in a long term, they will be easily damaged and will bring users much inconvenience. Especially when they are used in a condition of larger swing amplitude or when they are accommodated in headsets having a small volume, they will be easily broken, or the inconvenient use due to the overlarge volumes of wires themselves.

SUMMARY OF THE INVENTION

The main object of the present invention is to provide a headphone wire, in which inner cores are interwoven inside an insulating skin, so as to reduce space and increase flexibility thereof, and a connecting terminal is in connection therewith by means of riveting, which is easily assembled, easily repaired, and capable of increasing service life.

To achieve the object mentioned above, the present invention proposes a headphone wire, including a plurality of interwoven inner cores, an insulating skin covering the outside of the inner cores, an electroplating end defined by the inner cores and penetrated out of the insulating outer skin, a tin-plated portion electroplated on the electroplating end, and a connecting terminal riveted onto the tin plated portion, where each inner core includes a conductor and enamel layer coated on the conductor.

With the above structure, a user first interlaces the inner cores together at one position, and covers the insulating skin on the outside of the inner cores. Thereafter, one end of the inner cores is penetrated out of the insulating skin to form an electroplating end, on which a tin plated portion is electroplated, and a connecting terminal is finally riveted onto the tin plated portion. Thus, the conductor inside the inner core can be used to achieve a connection effect, and the insulation effect can be achieved through the insulating skin. Furthermore, one end of inner cores penetrated out of the insulating skin can be used conveniently; space can be much more saved because the inner cores are interwoven together; the conductor of the inner cores covered with the enamel layer can increase its use effect, and the inner cores penetrated out of the insulating outer skin has the tin plated portion riveted to the connecting terminal, which is more stable and reliable, also having more service life compared to conventional spot welding.

With the above technology, a breakthrough has been made to solve the problem of conventional wire rods having a large volume and short service life, achieving practical advancement through the above advantages, and capable of easy assembly and easy repair.

DETAILED DESCRIPTION OF THE PREFERRED EMBODIMENTS

Figure 1:
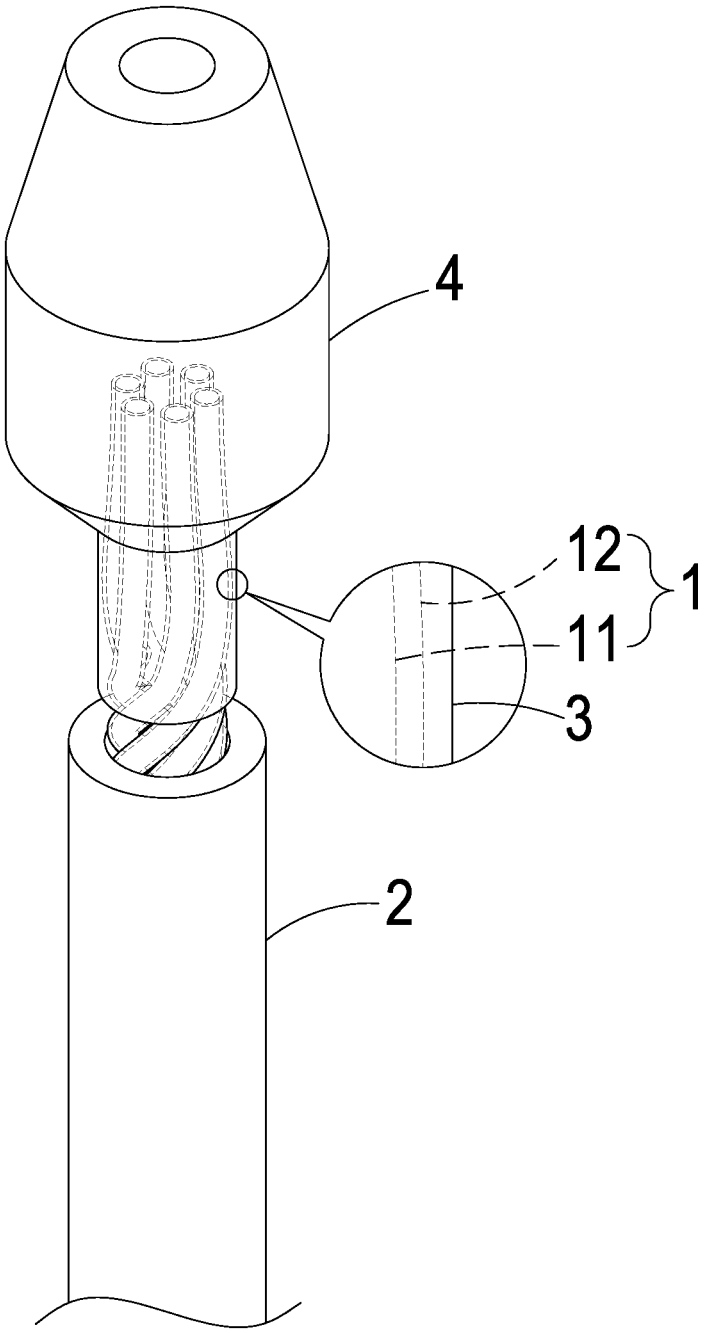
FIG. 1 is a perspective view of a preferred embodiment of the present invention.
Figure 2:
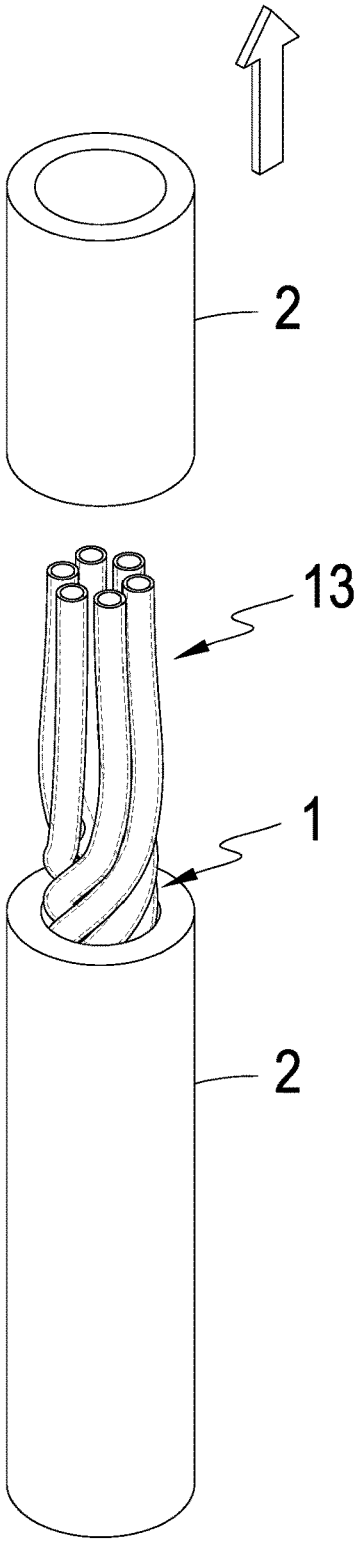
FIG. 2 shows a part of insulating skin peeling of the preferred embodiment of the present invention.

Referring to FIG. 1 and FIG. 2, a headphone wire of the present invention includes a plurality of inner cores 1, insulating skin 2, tin plated portion 3 and connecting terminal 4, where the plurality of inner cores 1 are intertwined with a helical or cross shape, but the present invention is not so limited. Each inner core 1 includes a conductor 11 and an enamel coating layer 12 coated on the outside of conductor 11; the insulating skin 2 is covered outside the plurality of inner cores 1, and one end of each inner core 1 is penetrated out of the insulating skin 2 to form an electroplating end 13, electroplated with the tin plated portion 3, and the connecting terminal 4 is riveted onto the tin plated portion 3.

With the above description, the technical structure of the present invention can be understood, and according to the corresponding coordination of the structure, the inner cores 1 being interwoven together can further be utilized to reduce volume, and riveting instead of conventional spot welding to increase service life; the details will be explained as the following.

With the above components in combination one another, it can be clearly seen from the figures that a user must first weave the inner cores 1 interlaced together at one position in order to achieve the volume reduction, and the conductors 11 thereof can be used for electric connection. And the enamel coating layer 12 then has an insulation effect, allowing each conductor 11 not to be in electric connection with each other. Thereafter, the insulating skin 2 is then covered on the outside of the inner cores, thereby achieving an entire insulation effect. Furthermore, the insulating skin 2 on one end of each inner core 1 is then peeled off to allow the inner cores 1 to form an electroplating end 13 on which with tin plated, thereby forming the tin plated portion 3, onto which the connecting terminal 4 is riveted. Thus, it can have a longer service life compared to conventional spot welding connection.

In the embodiment, the diameter of the inner core 1 is in the range between 0.3 millimeters and 1.2 millimeters, the best value is 0.7 millimeters.

The thickness of the enamel coating layer 12 is in the range between 0.03 millimeters and 0.2 millimeters, the best value is 0.08 millimeters.

The thickness of the tin plated portion 3 is in the range between 0.2 millimeters and 0.5 millimeters, the best value is 0.3 millimeters.

The thickness of the insulating skin 2 is in the range between 0.3 millimeters and 2.0 millimeters.

When relative values fall within the above corresponding ranges, the cost saving and better connection can be achieved at the same time, easily assembled and easily maintained.

In the embodiment, the tin plated portion 3 must cover the inner cores 1 on the electroplating end 13 uniformly, thereby preventing from being bifurcation and disorder of the inner cores 1, and further allowing the manufacturing process to be more efficient, easily assembled and easily maintained.

However, the above descriptions are merely preferred embodiments of the present invention, and cannot be used to limit the scope of implementation of the present invention. Any simple and equivalent variations and modifications made according to CLAIMS and SUMMARY of the present invention should fall within the scope of the present invention.

Therefore, the headphone wire of the present invention has the advantages that the inner cores 1 being interwoven together is used to reduce the volume and increase flexibility, and the terminal 4 is connected by means of riveting instead of conventional spot welding to increase service life.

I claim:

1. A headphone wire, comprising:

a plurality of inner cores, each comprising a conductor and enamel coating layer, said conductor adapted for connection and transferring, and said enamel coating layer covered on the outside of said conductor for insulation;

an insulating skin, covered on said inner cores, and said plurality of inner cores interwoven together inside said insulating skin, and one end of said inner cores penetrated out of said insulating skin and defining an electroplating end;

a tin plated portion, configured on said electroplating end; and a connecting terminal, riveted onto said tin plated portion.

2. The headphone wire according to claim 1, wherein a diameter of each said inner core is in the range between 0.3 millimeters and 1.2 millimeters.

3. The headphone wire according to claim 1, wherein a thickness of said enamel coating layer is in the range between 0.03 millimeters and 0.2 millimeters.

4. The headphone wire according to claim 1, wherein said inner cores are interwoven together in a helical shape.

5. The headphone wire according to claim 1, wherein said inner cores are interwoven together in a cross-shaped form.

6. The headphone wire according to claim 1, wherein a thickness of said insulating skin is in the ranged between 0.3 millimeters and 2.0 millimeters.

7. The headphone wire according to claim 1, wherein said tin plated portion is covered on said electroplating end uniformly.

8. The headphone wire according to claim 7, wherein a thickness of said tin plated portion is in the range between 0.2 millimeters and 0.5 millimeters.

* * * * *